United States Patent [19]

Kroger

[11] Patent Number: 4,570,832

[45] Date of Patent: Feb. 18, 1986

[54] DISPENSING DEVICE IN THE FORM OF A CAULKING GUN

[75] Inventor: Mogens Krøger, Brønshøj, Denmark

[73] Assignee: M. Kroger Maskinfabrik A/S, Greve Strand, Denmark

[21] Appl. No.: 592,088

[22] Filed: Mar. 22, 1984

[30] Foreign Application Priority Data

Mar. 23, 1983 [DK] Denmark ..... 1318/83

[51] Int. Cl.[4] ..... B65D 88/54

[52] U.S. Cl. ..... 222/325; 222/389; 604/70; 604/143

[58] Field of Search ..... 222/389, 325, 326, 327, 222/386; 604/140, 141, 143, 147, 232, 234, 70, 72

[56] References Cited

U.S. PATENT DOCUMENTS

| | | | |
|---|---|---|---|
| 1,606,034 | 11/1926 | MacGregor | 604/232 |
| 3,319,839 | 5/1967 | Cox | 222/327 |
| 4,376,498 | 3/1983 | Davis, Jr. | 222/389 |
| 4,453,651 | 6/1984 | Braithwaite et al. | 222/389 |

FOREIGN PATENT DOCUMENTS

| | | | |
|---|---|---|---|
| 0052060 | 5/1982 | European Pat. Off. | 222/389 |
| 1255990 | 2/1961 | France | 222/389 |

*Primary Examiner*—Joseph J. Rolla
*Assistant Examiner*—Louise S. Heim
*Attorney, Agent, or Firm*—Cushman, Darby & Cushman

[57] ABSTRACT

A dispensing device in the form of a caulking gun is adapted to receive interchangeable cartridges. In addition, it comprises means introducing compressed air at activation into the cartridge from behind so as pneumatically to press a piston plate present therein and consequently the material present in the cartridge forward towards the discharge nozzle of the cartridge. In order to permit an easy interchanging of the cartridge as well as to obtain a very simple caulking gun, the dispensing device comprises an open supporting means and a sealing piston. The sealing piston is adapted to be sealingly pressed against the rim of the cartridge from behind so as to close said rim when the cartridge is pressed against the front end of the supporting means. At the same time the caulking gun comprises a passage extending through the sealing piston so as to permit compressed air to enter at the rear end of the cartridge at activation.

4 Claims, 3 Drawing Figures

DISPENSING DEVICE IN THE FORM OF A CAULKING GUN

FIELD OF THE INVENTION

The present invention relates to a dispensing device in the form of a caulking gun or the like for interchangeable cartridges, where the dispensing device comprises means introducing compressed air at activation into the cartridge from behind so as pneumatically to press a piston plate present therein and consequently the material present in the cartridge forward towards the discharge opening of the cartridge, said dispensing device comprising a supporting means or holder for receiving a cartridge, and a sealing piston adapted to be pressed sealingly against the rim of the cartridge from behind so as thereby to close said rim by pressing the cartridge against the front end of the supporting means, and whereby the compressed-air means comprise a passage for the compressed air through the sealing piston.

BACKGROUND ART

Many various caulking guns and the like dispensing devices are known, which are adapted to be used in connection with interchangeable cartridges available in standard sizes. Such caulking guns are also known whereby the material is expelled from the cartridges by means of compressed air introduced into the cartridge from behind. When it is a question of detachable cartridges, the replacement is often complicated and time-consuming. Often they must be situated in a closed container being screwed off and on the remaining portion of the dispensing device during the replacement of the cartridge. The known caulking guns sometimes require that the front end of the cartridge must be pressed hard against a packing, and when the sealing of this packing is insufficient there is a risk of compressed air leaking round the cartridge, past this packing, and into the expelled material.

European patent application No. 52,060 discloses a dispensing device comprising a holder receiving a cartridge and a sealing piston. This sealing piston is adapted to be pressed against the rim of the cartridge so as thereby to close said rim when the cartridge is being pressed against the front end of the holder. The sealing piston is constantly biased by a spring in a direction towards the front end of the holder, and furthermore it is displaceably mounted in axial direction partly inside a cylinder and partly on a bolt coaxially secured in said cylinder. The head of the bolt is used for restricting the movement of the piston forward towards the front end of the holder, and when the piston abuts this head the passage is closed for the compressed air from the interior of the cylinder to the space surrounding the bolt and the clearance usually present between the bolt and the piston. In addition, bores are present to ensure that the pressure within the cylinder is not so high when the dispensing device is not in use and no cartridge is situated in the dispensing device that the circumferential lip of the piston is bent forward out of engagement with the cylinder, said lip sealingly abutting the inner side of the cylinder.

SUMMARY OF THE INVENTION

The dispensing device according to the invention is characterized by the sealing piston being pneumatically driven, and by the passage of the sealing piston being associated with a reducing valve adapted to open so as to permit passage of compressed air when the sealing piston is counteracted by a predetermined force, preferably from a cartridge.

In this manner a dispensing device is provided which permits a quick and easy replacement of the cartridges when said cartridges are empty. This is particularly due to the fact that the sealing piston is pneumatically actuated and therefore remains completely freely displaceably mounted when the introduction of compressed air is interrupted, and consequently no spring forces need be overcome. The cartridge is merely situated in the supporting means or the holder, and the closing is carried out solely by means of the pressing of the sealing piston against the rear end of the cartridge while being held by the front end of the supporting means or the holder. At the same time a leakage of compressed air is avoided while the cartridge is being correctly situated in the supporting means.

Furthermore according to the invention, the sealing piston may be connected to a driving piston displaceably mounted in a housing, which the compressed air enters at activation, and the passage through the sealing piston may also extend through said driving piston. As a result, a particularly simple dispensing device is obtained.

Finally according to the invention, the supporting means or the holder may be detachable, the device comprising a sleeve axially behind the sealing piston, said sleeve extending coaxially with the sealing piston and comprising a radial flange and being adapted to receive a radial plate member on the rear end of the supporting means or the holder, where the plate member comprises a recess receiving the axial portion of the sleeve. In this manner an easy and quick replacement of the supporting means is permitted when the driving means is to be adapted to standard cartridges of other lengths. The easily detachable supporting means is a further advantage when a less bulky storing of the dispensing device is necessary.

BRIEF DESCRIPTION OF DRAWING

The invention will be described below with reference to the accompanying drawing, in which.

DESCRIPTION OF PREFERRED EMBODIMENTS

Figure 2:
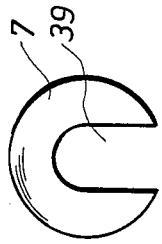
FIG. 2 is a rear view of the rear radial plate of the supporting means.
Figure 1:
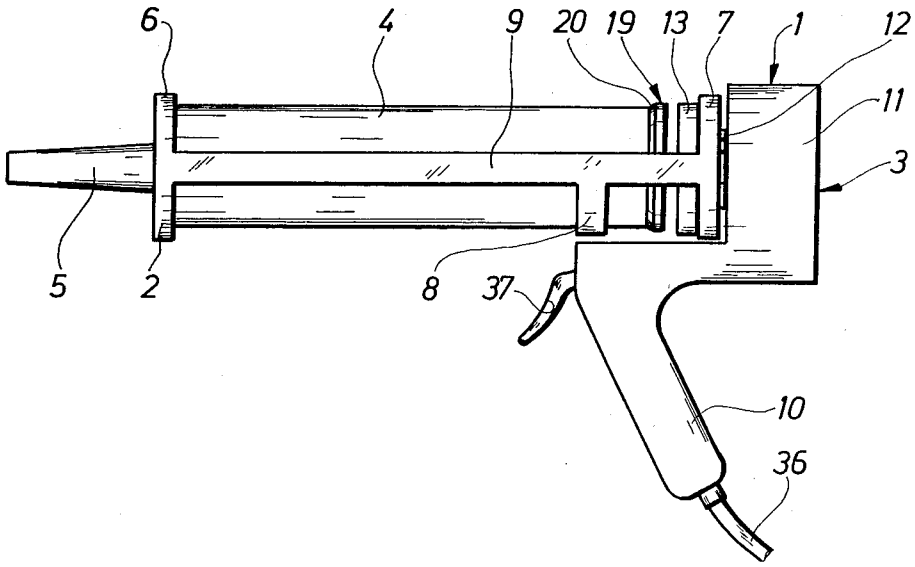
FIG. 1 illustrates a dispensing device according to the invention with a cartridge situated in the supporting means of the dispensing device.

The dispensing device illustrated in FIG. 1 is provided with the general reference numeral 1 and comprises a supporting means or a holder 2 detachably secured to a release and propelling part provided with the general reference numeral 3. The supporting means 2 is adapted to receive a cartridge 4 containing a material such as caulking material. The cartridge 4 is of a generally known type comprising a discharge nozzle 5 of varying shapes and detachably secured on a smaller nozzle (not shown) which is fixed onto the cartridge 4. In a generally known manner the cartridge comprises a displaceable body of varying shapes and shortly referred to as the piston plate (not shown) of the cartridge. At displacement forward towards the nozzle 5, the piston plate is adapted to press the material contained in the cartridge out through the nozzle 5. In front, the supporting means 2 comprises a radial part 6 of any suitable shape permitting an introduction or mounting of the nozzle 5 on the cartridge. At the back, the supporting means 2 also comprises a radial part 7 shaped as described more detailed below and seen from behind in FIG. 2. The supporting means furthermore comprises a supporting member 8 extending in the transverse direction of the supporting means between two rods 9 extending at their respective side in the longitudinal direction, only one rod being illustrated in FIG. 1. The supporting member is of a shape mating to the cartridge, which usually is circular in cross section. The supporting member 8 is therefore preferably substantially curved too and is furthermore shaped in such a form that the cartridge 4 correctly situated in the supporting means 2 is supported substantially coaxially with the central axis of the supporting means 2.

Figure 3:
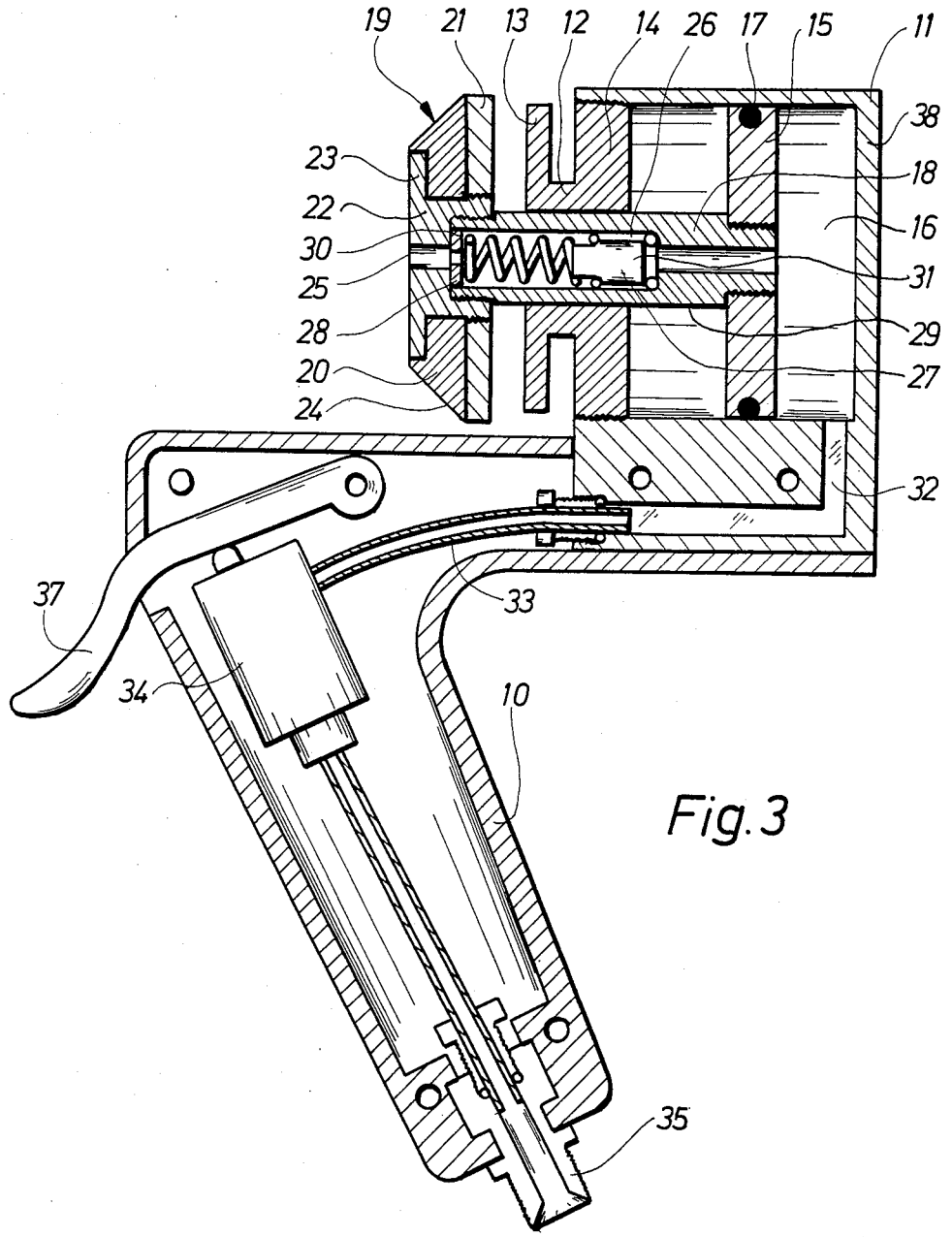
FIG. 3 is on a larger scale a diagrammatic, sectional view through part of the dispensing device.

The release and propelling part 3 of the dispensing device comprises a handle 10 connected to a propelling housing 11, cf. FIG. 3 too. In front the propelling housing comprises a sleeve-shaped part 12 carrying in front a radial circular flange 13. The sleeve 12 and the associated flange 13 are dimensioned in such a manner that the sleeve can co-operate with the radial rear part 7 of the supporting means, whereby the supporting means 2 can be detachably secured on the release and propelling part 3 of the dispensing device by mounting the rear part 7 of the supporting means on the sleeve 12, said sleeve being received in a suitable recess 13 in the rear radial part 7 of the supporting means 2. The rear radial part 7, cf. FIG. 2, of the supporting means 2 is furthermore dimensioned in such a manner that the supporting means 2 is fixed coaxially with the sleeve 12. The distance in axial direction between the flange 13 and the front wall 14 of the propelling housing 11 is suitably such that the supporting means is fixed through friction therebetween. In FIG. 1 this distance has been slightly exaggerated for the sake of clarity.

As illustrated in FIG. 3, the propelling housing 11 comprises a driving piston 15 displaceably mounted in the cavity 16 in the housing 11. The driving piston 15 is of the same shape as the cross section of the cavity 16 and is sealingly connected with the walls of the cavity 16 by means of a circumferential sealing means 17. The driving piston 15 is solidly connected to a piston rod 18 extending coaxially and slidably out through the front wall 14 of the housing and the sleeve 12. Outside the housing 11, the piston rod 18 carries a sealing piston provided with the general reference numeral 19 and of a frusto-conical shape, its inclined sides being formed by a sealing means 20, preferably of rubber. This sealing means 20 is squeezed between a radial plate 21 and a squeezing sleeve 22 with a circumferential flange 23. The squeezing sleeve and the radial plate are interconnected by means of threads.

The sealing piston 19 is dimensioned in such a manner that its inclined circumferential surface 24 may co-operate with the circumferential inner edge of the rear end of the cartridge 4. At a suitable pressing this inclined surface closes the rear end of the cartridge in a completely sealing manner. In addition, the driving piston is dimensioned in such a manner that the inclined circumferential surface may co-operate with cartridges of varying diameters within the variations applying to standard cartridges 4.

A passage 25 extends coaxially with the driving piston 15, the sleeve 12, and the sealing piston 19 through said driving piston 15, the piston rod 18, and the sealing piston 19. Inside the piston rod, this passage has an extended part 26 enclosing a reducing valve 31. The reducing valve 31 comprises a valve body 27 which by means of a biased spring 28 is pressed against a circumferential sealing means 29. Especially for securing the parts of the reducing valve during the mounting, the spring 28 is kept in its position inside the piston rod 18 by means of a disc 30 retained in the piston rod 18 by means of friction. As indicated in FIG. 3, the piston rod 18 is secured to the sealing piston 19 by means of threads.

At the back, a passage 32 extends from the cavity 16. Through a conduit 33 comprising a release valve 34, this passage 32 communicates with a stub 35 situated on the lower portion of the handle 10. This stub permits the connecting of the dispensing device to a compressed-air conduit, cf. FIG. 1, which communicates with a suitable compressed-air source. The release valve 34 is adapted so as to be released by means of a trigger 37 in such a manner that when the user activates the trigger 37, the passage of compressed air is opened through the conduit 33 to the cavity 16 in the portion between the driving piston 15 and the rear wall 38 of the housing.

When it is desired to use the dispensing device, a cartridge 4 is situated in the supporting means 2, whereafter the user presses the trigger 37 so as to open the passage for compressed air to the cavity 16. The compressed air in the cavity 16 drives initially the driving piston 15 and consequently the sealing piston 19 axially forward until the sealing means 20 sealingly abuts the inner edge of the rear end of the cartridge. At continuous flow of compressed air, the pressure inside the cavity 16 is increased to a level permitting displacement of the valve body 27 of the reducing valve 31 against the biasing force of the biased spring 28 in such a manner that passage of compressed air is permitted through the reducing valve 31 and consequently through the entire passage 25 to the interior of the cartridge. At continuous flow of compressed air, compressed air thus enters the cartridge behind the piston plate thereof, which thereby is pressed forward while pressing out the material in the cartridge 4.

The driving piston 15 and the reducing valve 31 are mutually dimensioned in such a manner that the reducing valve 31 does not open the passage for compressed air until the sealing piston 19 is counteracted by a suitably high force from the cartridge 4. Thus it is ensured that the sealing piston 19 sealingly closes the rear end of the cartridge. The cartridge 4 is during this procedure pressed against the front radial part 6 of the supporting means 2.

The invention has been described with reference to a preferred embodiment. Many modifications may, of course, be carried out without thereby deviating from the scope of the invention. The supporting means may for instance be of many different shapes and be permanently secured to the remaining portion of the dispensing device. Thus the supporting means 2 may be shaped as a trough-shaped container for the cartridge 4. An important feature is, however, that the cartridge may tilt slightly in the supporting means or the holder 2 in such a manner that unless it is always ensured a correct positioning relative to the sealing piston 19, it is automatically correctly positioned by means of the sealing piston 19.

I claim:

1. A pneumatic caulking gun comprising a supporting means for receiving an interchangeable caulk-containing cartridge, said cartridge having a dispensing nozzle at its forward end and a rim at the rearward end, the caulking gun including a dispensing means comprising a source of pressurized air, a driving piston, a piston plate, a sealing piston capable of engaging the rim of said cartridge to close said rearward end, the sealing piston including a central passage in communication with said source of pressurized fluid whereby fluid pressure urges the caulk from the cartridge, the central passage including a valve member adapted to open at a predetermined pressure of the pressurized fluid, the dispensing means being arranged such that said fluid pressure urges the sealing piston into engagement with the cartridge and subsequently opens said valve when the predetermined pressure is attained thereby allowing fluid to flow through the central passage to urge the caulk from the cartridge.

2. A caulking gun as claimed in claim 1, characterized by the sealing piston being connected to the driving piston, said driving piston being displaceably mounted in a housing to which the compressed air enters, the central passage extending through the sealing piston and through said driving piston.

3. A caulking gun as claimed in claim 2, characterized by the supporting means being detachable from the dispensing means, the housing including a sleeve receiving the piston rod, said sleeve extending coaxially with the sealing piston and comprising a radial flange adapted to receive a radial plate member of the supporting means, where the plate member comprises a recess for receiving the axial portion of the sleeve.

4. A pneumatic caulking gun comprising a supporting means for receiving an interchangeable caulk-containing cartridge, said cartridge having a dispensing nozzle at its forward end and a rim at its rearward end, the caulking gun including a dispensing means comprising a housing receiving a reciprocating drive piston, a source of pressurized fluid for driving said drive piston connected to the housing, the driving piston having a piston rod including a sealing piston at one end, said sealing piston being capable of engaging the rim of the cartridge, the piston rod having a central passage for communicating the source of pressurized fluid to the cartridge when the sealing piston engages the cartridge, the central passage further including a pressure operated valve means, the dispensing means being arranged such that fluid pressure acts on the drive piston whereby the sealing piston is moved into sealing engagement with the cartridge and upon sufficient fluid pressure the valve means opens thereby supplying fluid pressure through the central passage to the cartridge to urge the caulk from the cartridge.

* * * * *